US011000961B2

(12) United States Patent
Brellis

(10) Patent No.: US 11,000,961 B2
(45) Date of Patent: May 11, 2021

(54) SHAVING HEAD

(71) Applicant: BIC-VIOLEX S.A., Anixi (GR)

(72) Inventor: Christoforos-Athanassios Brellis, Athens (GR)

(73) Assignee: BIC-VIOLEX SA, Anixi (GR)

( * ) Notice: Subject to any disclaimer, the term of this patent is extended or adjusted under 35 U.S.C. 154(b) by 0 days.

(21) Appl. No.: 15/769,385

(22) PCT Filed: Dec. 16, 2016

(86) PCT No.: PCT/IB2016/057723

§ 371 (c)(1),
(2) Date: Apr. 19, 2018

(87) PCT Pub. No.: WO2017/103881

PCT Pub. Date: Jun. 22, 2017

(65) Prior Publication Data

US 2018/0354146 A1 Dec. 13, 2018

Related U.S. Application Data

(60) Provisional application No. 62/268,643, filed on Dec. 17, 2015.

(51) Int. Cl.

| | |
|---|---|
| ***B26B 21/40*** | (2006.01) |
| ***B26B 21/22*** | (2006.01) |
| ***B26B 21/44*** | (2006.01) |

(52) U.S. Cl.

CPC ..... *B26B 21/4012* (2013.01); *B26B 21/222* (2013.01); *B26B 21/4018* (2013.01); *B26B 21/4025* (2013.01); *B26B 21/4068* (2013.01); *B26B 21/443* (2013.01)

(58) Field of Classification Search

CPC ..... B26B 21/4012; B26B 21/4018; B26B 21/4025; B26B 21/4068; B26B 21/227; B26B 21/222

USPC ..... 30/50, 77

See application file for complete search history.

(56) References Cited

U.S. PATENT DOCUMENTS 1,455,726 A * 5/1923 Hartman ..... B26B 21/52 30/529
5,369,885 A * 12/1994 Ferraro ..... B26B 21/227 30/41
5,761,814 A * 6/1998 Anderson ..... B26B 21/4068 30/50

(Continued)

FOREIGN PATENT DOCUMENTS

CN 101080308 A 11/2007
CN 103608153 A 2/2014

(Continued)

OTHER PUBLICATIONS

International Search Report for PCT/IB2016/057723, dated Feb. 20, 2017.

(Continued)

*Primary Examiner* — Laura M Lee
(74) *Attorney, Agent, or Firm* — Polsinelli PC

(57) ABSTRACT

A shaving head for a shaver has a side-cap retainer secured to sides of the shaving head. Each of the retainers has a plurality of legs operable to abut various portions of the shaving head, thereby securing components of the shaving head thereto.

16 Claims, 5 Drawing Sheets

(56) References Cited

U.S. PATENT DOCUMENTS 5,794,343 A * 8/1998 Lee ..... B26B 21/4012 30/50
6,009,624 A * 1/2000 Apprille, Jr. ..... B26B 21/227 30/50
6,035,537 A * 3/2000 Apprille, Jr. ..... B26B 21/227 30/346.5
6,044,542 A 4/2000 Apprille, Jr. et al.
8,307,553 B2 * 11/2012 Follo ..... B26B 21/225 30/41
8,707,561 B1 * 4/2014 Kneier ..... B26B 19/42 30/34.2
9,149,945 B2 * 10/2015 Tomassetti ..... B26B 21/48
9,539,734 B1 * 1/2017 Bozikis ..... B26B 21/227
10,744,662 B2 * 8/2020 Bozikis ..... B26B 21/4012
10,800,056 B2 * 10/2020 Kim ..... B26B 21/4012
2006/0123631 A1 6/2006 Szczepanowski et al.
2006/0260131 A1 * 11/2006 Follo ..... B26B 21/225 30/50
2010/0077619 A1 * 4/2010 Follo ..... B26B 21/225 30/50
2012/0317818 A1 * 12/2012 Oglesby ..... B26B 21/4018 30/77
2012/0324737 A1 * 12/2012 Howell ..... B26B 21/4031 30/50
2013/0097872 A1 * 4/2013 Blatter ..... B26B 21/4018 30/50
2013/0205595 A1 * 8/2013 Bykowski ..... B26B 21/4012 30/64
2015/0082638 A1 * 3/2015 Georgakis ..... B26B 21/222 30/77
2017/0151683 A1 * 6/2017 Bozikis ..... B26B 21/227
2017/0173805 A1 * 6/2017 Ren ..... B26B 21/443
2018/0264669 A1 * 9/2018 Howell ..... B26B 21/60
2018/0311846 A1 * 11/2018 Brellis ..... B26B 21/4025
2018/0311847 A1 * 11/2018 Ntavos ..... B26B 21/4012

FOREIGN PATENT DOCUMENTS

WO 94/11163 5/1994
WO 99/16592 4/1999
WO WO-2012158142 A1 * 11/2012 ..... B26B 21/227

OTHER PUBLICATIONS

Chinese Search Report for Chinese Patent Application No. CN2016800633961, dated Oct. 9, 2019.

* cited by examiner

SHAVING HEAD

CROSS-REFERENCE TO RELATED APPLICATION

This application is a National Stage of International Application No. PCT/IB2016/057723, filed Dec. 16, 2016, which claims priority to U.S. Provisional Patent Application No. 62/268,643, filed in the U.S. Patent and Trademark Office on Dec. 17, 2015, all of which are incorporated herein by reference in their entireties for all purposes.

BACKGROUND

1. Field

The following description relates to shaving razors. A shaving razor may include a head with one or more blades and a retainer configured to retain components of the shaving head. For example, a shaving razor may include a head with one or more blades which are secured in the head by a side cap retainer. The side cap retainer may include a plurality of legs to abut various portions of the shaving head, thereby securing components of the shaving head thereto.

2. Description of Related Art

Shaving razors include shaving heads which contain components such as shaving blades, lubrication strips, guard bars, covers, and trimming blades. The components in conventional shaving heads would be individually and separately retained within the shaving head. As such, the components would each have separate retaining means; for example traditional clips may be utilized for each component. However, bending traditional clip legs at multiple locations of the cartridge provides for difficulties in manufacturing while also providing multiple locations for retaining the components and managing the tolerances that are applied.

Further, several disadvantages are typically encountered in the manufacture of such conventional mechanisms. During the manufacturing process, clips may encounter buckling as a result of force that is applied during installation of the clips. As a result of bending force exerted on the clips, the clips have a tendency to buckle upwards. Consequently, blade exposures may be unstable throughout the razor cartridge and may vary significantly from intended blade exposure values. Also, during the manufacturing process, clips may fail to be properly installed in a razor housing, which requires additional attention and labor to ensure that all of the clips are properly installed in the housing. Thus, the manufacture of such conventional mechanisms is inefficient, which results in production delays and increased production costs.

SUMMARY

The present inventive concept provides a shaving razor that overcomes the aforementioned disadvantages of conventional shaving razors. The shaving razor of the present inventive concept generally includes a shaving head with a housing and one or more components. The components may be at least one blade, a guard bar, a cap, at least one lubrication strip, or a combination thereof. The components are partially covered and secured to the housing by a retainer securely mounted on each side of the shaving head.

The aforementioned may be achieved in an aspect of the present inventive concept by providing a shaver head having at least one shaving head component extending at least partially along a length of the shaver head, a first groove extending at least partially along a first side of the at least one shaving head component, a second groove extending at least partially along a second side of the at least one shaving head component, and/or a retainer secured within at least one groove and operable to secure the at least one shaving head component to the shaver head. Each retainer may have (i) a central retainer body extending along a plane, (ii) a front leg extending from a front of the body, and/or (iii) a rear leg extending from a rear of the body.

Each of the grooves may extend (i) at least partially along the length of the shaver head, and/or (ii) perpendicular to the plane defined by the body. The front leg and the rear leg may at least partially extend (i) substantially parallel to each other along the plane, and/or (ii) at an angle to the plane defined by the body. One or both of the angles may have a range of 100-150 degrees. A side leg may extend from a side of the body. The angles may be equal to or different than each other.

Each of the front leg, the rear leg, and the side leg may (i) partially surround a portion of the shaving head, or (ii) extend into the first groove and the second groove. The side leg may be operable to surround a side portion of the shaving head and/or abut a bottom portion of the shaving head. The front leg and the rear leg may include (i) a linear portion extending parallel to the body along the plane, and/or (ii) a curved portion that causes the front leg and the rear leg to extend nonparallel to the body.

The body may include an abutment surface operable to abut one or more shaving head components. The front leg, the rear leg, and/or the side leg may include an abutment surface operable to abut (i) a bottom side of the shaving head, (ii) the first groove, or (iii) the second groove. The abutment surfaces of the body and the side leg may be on an interior side facing the interior cavity. One or both of the abutment surfaces of the front leg and the rear leg may be on an exterior side. One or both of the front leg and the rear leg may be operable to be simultaneously received into a respective one of the front groove and the rear groove. One or both of the front leg and the rear leg may be operable to slide along a portion of a respective one of the front groove and the rear groove until a portion of the side leg abuts the shaving head.

An entirety or only a portion of the retainer may be formed of a resilient material. The retainer may be operable to flex during installation of the retainer on the shaving head. After installation of the retainer on the shaving head, the retainer may be operable to remain in an expanded configuration thereby securing the retainer to the shaving head via a spring force. The expanded configuration may be different than an uninstalled configuration of the retainer prior to being installed on the shaving head. The retainer may be operable to flex via movement of the side leg relative to the front leg and/or rear leg of the retainer.

The foregoing is intended to be illustrative and is not meant in a limiting sense. Many features of the embodiments may be employed with or without reference to other features of any of the embodiments. Additional aspects, advantages, and/or utilities of the present inventive concept will be set forth in part in the description that follows and, in part, will be apparent from the description, or may be learned by practice of the present inventive concept.

BRIEF DESCRIPTION OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the present inventive concept is not limited to the precise embodiments and features shown. The accompanying drawings, which are incorporated in and constitute a part of this specification, illustrate an implementation of apparatuses consistent with the present inventive concept and, together with the description, serve to explain advantages and principles consistent with the present inventive concept.

DETAILED DESCRIPTION

Figure 1:
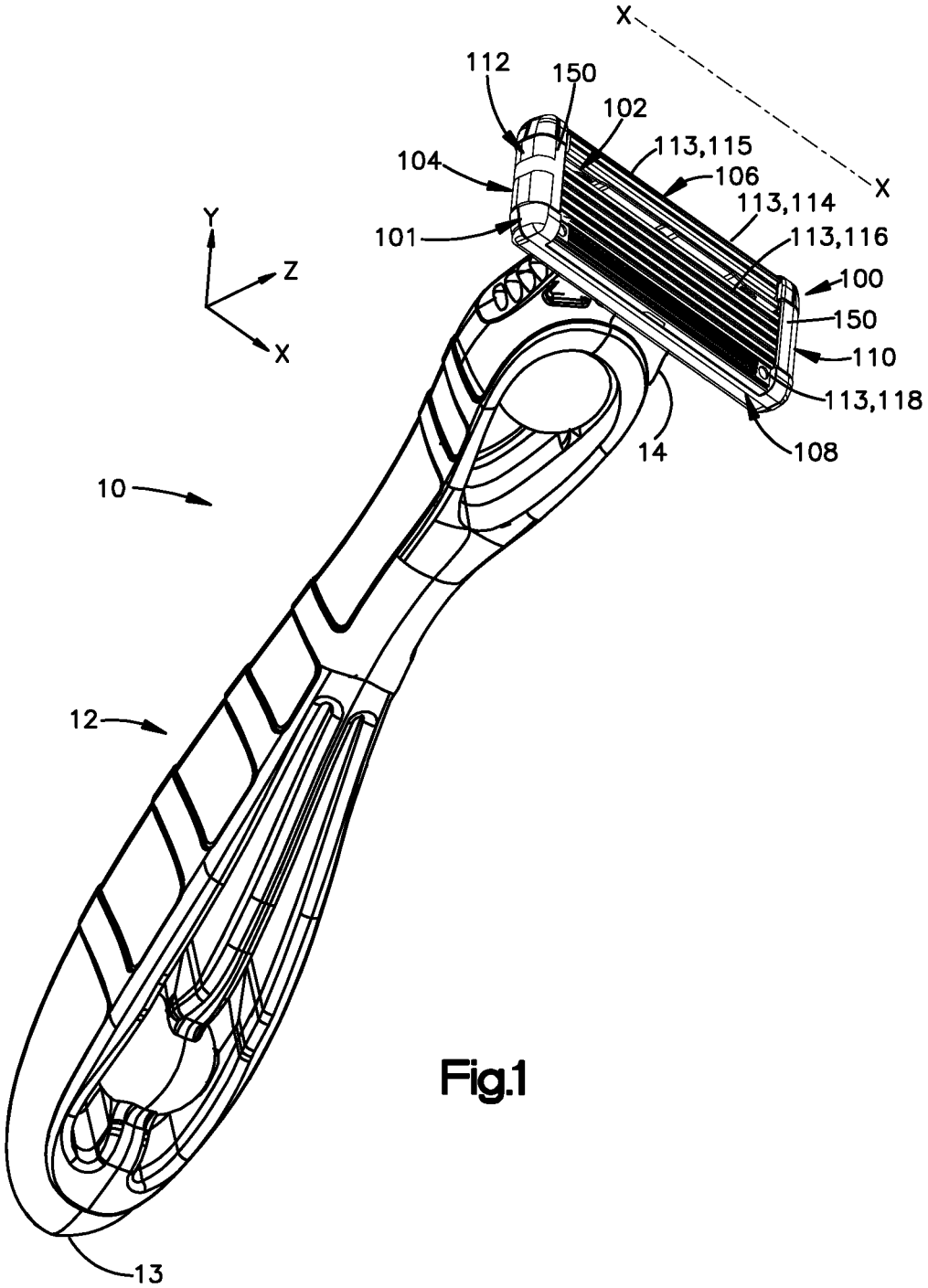
FIG. 1 is a diagram illustrating a perspective view of a shaving razor with a handle and a shaving head.
Figure 2:
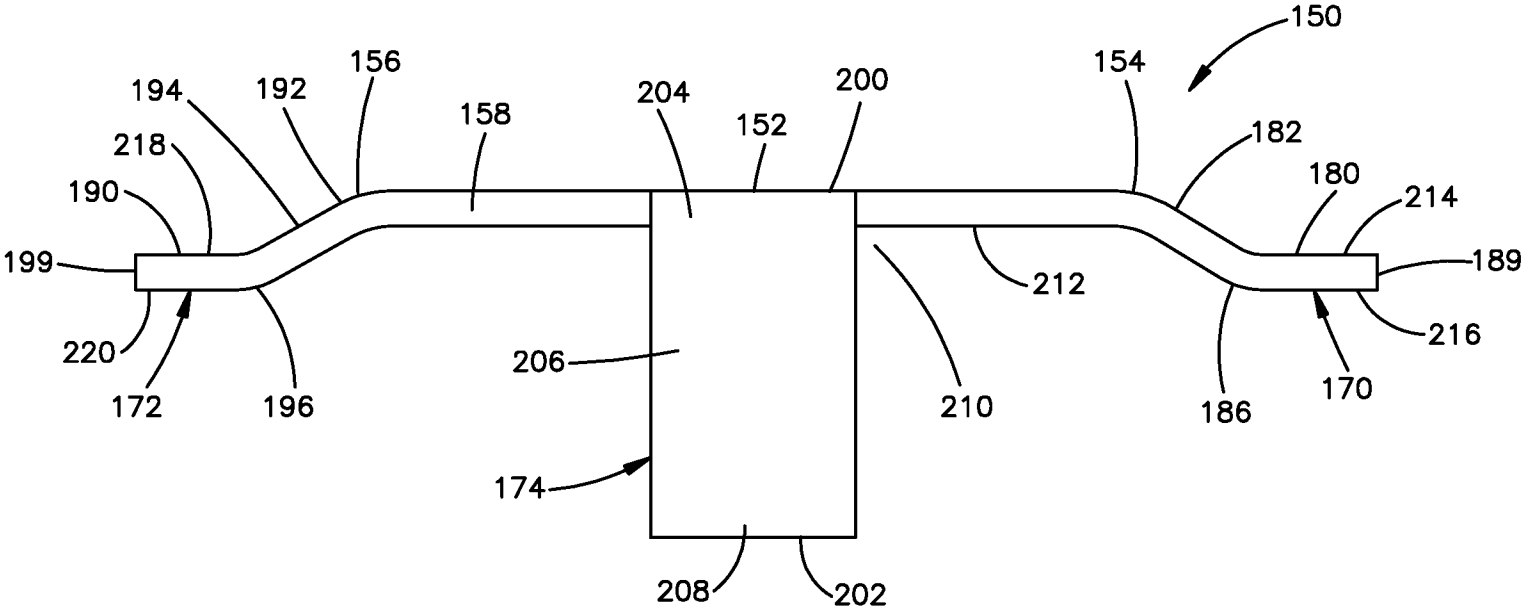
FIG. 2 is a diagram illustrating a side elevation view of a retainer of FIG. 1.

It is to be understood that the present inventive concept is not limited in its application to the details of construction and to the embodiments of the components set forth in the following description or illustrated in the drawings. The figures and written description are provided to teach any person skilled in the art to make and use the inventions for which patent protection is sought. The present inventive concept is capable of other embodiments and of being practiced and carried out in various ways. Persons of skill in the art will appreciate that the development of an actual commercial embodiment incorporating aspects of the present inventive concept will require numerous implementations—specific decisions to achieve the developer's ultimate goal for the commercial embodiment. While these efforts may be complex and time-consuming, these efforts, nevertheless, would be a routine undertaking for those of skill in the art of having the benefit of this disclosure.

I. Terminology

The phraseology and terminology employed herein are for the purpose of description and should not be regarded as limiting. For example, the use of a singular term, such as, "a" is not intended as limiting of the number of items. Also, the use of relational terms such as, but not limited to, "top," "bottom," "left," "right," "upper," "lower," "down," "up," and "side," are used in the description for clarity in specific reference to the figures and are not intended to limit the scope of the present inventive concept or the appended claims. Further, it should be understood that any one of the features of the present inventive concept may be used separately or in combination with other features. Other systems, methods, features, and advantages of the present inventive concept will be, or become, apparent to one with skill in the art upon examination of the figures and the detailed description. It is intended that all such additional systems, methods, features, and advantages be included within this description, be within the scope of the present inventive concept, and be protected by the accompanying claims.

Further, any term of degree such as, but not limited to, "substantially," as used in the description and the appended claims, should be understood to include an exact, or a similar, but not exact configuration. For example, "a substantially planar surface" means having an exact planar surface or a similar, but not exact planar surface. Similarly, the terms "about" or "approximately," as used in the description and the appended claims, should be understood to include the recited values or a value that is three times greater or one third of the recited values. For example, about 3 mm includes all values from 1 mm to 9 mm, and approximately 50 degrees includes all values from 16.6 degrees to 150 degrees.

Further, as the present inventive concept is susceptible to embodiments of many different forms, it is intended that the present disclosure be considered as an example of the principles of the present inventive concept and not intended to limit the present inventive concept to the specific embodiments shown and described. Any one of the features of the present inventive concept may be used separately or in combination with any other feature. References to the terms "embodiment," "embodiments," and/or the like in the description mean that the feature and/or features being referred to are included in, at least, one aspect of the description. Separate references to the terms "embodiment," "embodiments," and/or the like in the description do not necessarily refer to the same embodiment and are also not mutually exclusive unless so stated and/or except as will be readily apparent to those skilled in the art from the description. For example, a feature, structure, process, step, action, or the like described in one embodiment may also be included in other embodiments, but is not necessarily included. Thus, the present inventive concept may include a variety of combinations and/or integrations of the embodiments described herein. Additionally, all aspects of the present disclosure, as described herein, are not essential for its practice. Likewise, other systems, methods, features, and advantages of the present inventive concept will be, or become, apparent to one with skill in the art upon examination of the figures and the description. It is intended that all such additional systems, methods, features, and advantages be included within this description, be within the scope of the present inventive concept, and be encompassed by the claims.

Lastly, the terms "or" and "and/or," as used herein, are to be interpreted as inclusive or meaning any one or any combination. Therefore, "A, B or C" or "A, B and/or C" mean any of the following: "A," "B," "C"; "A and B"; "A and C"; "B and C"; "A, B and C." An exception to this definition will occur only when a combination of elements, functions, steps or acts are in some way inherently mutually exclusive.

II. General Architecture

Turning to FIGS. 1-7, a shaving razor 10 is illustrated, which includes a handle 12 coupled with a shaving head 100. The handle 12 extends in a handle direction between a proximal end 13 and a distal end 14. The shaving head 100 is coupled with the distal end 14 of the handle 12. In at least one example, the shaving head 100 may be removably coupled with the handle 12, for example, by a lock and release mechanism. In other examples, the shaving head 100 may be fixedly coupled with the handle 12 such that the shaving head 100 is not configured to be removably coupled with or selectively separated from the handle 12. The shaving head 100 may be operable to pivot relative to the handle 12. In other examples, the handle 12 may be secured to the shaving head 100 in a fixed relationship such that the handle 12 is not operable to pivot relative to the shaving head 100. The handle 12 may be any suitable shape to allow a user to securely grip the handle 12. It is foreseen that the handle 12 may include one continuous curve or include one straight portion or several curved and/or straight portions extending along an entirety of or a substantial portion of the handle 12 without deviating from the scope of the present inventive concept.

The shaving head 100 includes a housing 101. The housing 101 extends along a longitudinal axis X-X. The housing 101, as illustrated, has a substantially rectangular shape, but may be any suitable shape such as ovoid or circular without deviating from the scope of the present inventive concept. The shaving head 100 and the housing 101 include a top side 102 and a bottom side 104 opposite the top side 102. The bottom side 104 is proximate to the handle 12, and the top side 102 includes at least one skin contacting area. The housing 101 includes first and second longitudinal walls 106, 108. Each of the first and second longitudinal walls 106, 108 extends longitudinally along the longitudinal axis X-X between the top and bottom sides 102, 104 and in a direction Z of the housing 101. The first and second longitudinal walls 106, 108 extend parallel to each other. First and second side walls 110, 112 extend parallel to each other and between the first and second longitudinal walls 106, 108 along a direction Y of the housing 101. The first and second side walls 110, 112 also extend between the top and bottom sides 102, 104 along the direction Z of the housing 101. The housing 101 may be made of plastic, metal, another suitable material, or any combination thereof without deviating from the scope of the present inventive concept.

The shaving head 100 includes a plurality of shaving head components 113 which assist and contribute to the shaving experience of the user. One of the plurality of shaving head components 113 is a plurality of blades 116 disposed and retained within the housing 101. The blades 116 extend along the longitudinal axis X-X. In at least one example, the shaving head 100 can include one, two, three, four, or more of the blades 116 without deviating from the scope of the present inventive concept. The blades 116 may be movably disposed or freely mounted, in the housing 101. For example, the blades 116 may be coupled with elastic fingers which extend from the housing 101. In other examples, the blades 116 may be fixedly disposed in the housing 101.

The plurality of shaving head components 113 also include a cap 114, a lubricating strip 115, and a guard bar 118 on and/or retained within the shaving head 100. The cap 114 is coupled with the first longitudinal wall 106. The lubricating strip 115 is disposed on the top side 102 of the cap 114 to deliver a friction reduction effect and/or an anti-irritation effect, and/or provide lubrication to skin of the user after the skin contacts the blades 116, thereby providing a smoother shave to the user. The guard bar 118 is coupled with the second longitudinal wall 108 opposite the cap 114 to stretch the skin during shaving or dispense forces applied to the skin during shaving, thereby causing the shaving head 100 to glide across the skin while providing a closer shave. The cap 114, the lubricating strip 115, and the guard bar 118 each extend along the longitudinal axis X-X. Additional components, e.g., a cover and/or one or more trimming blades, may also be included on and retained within the shaving head 100 without deviating from the scope of the present inventive concept.

The plurality of shaving head components 113 is retained within the shaving head 100 by retainers 150. For example, the retainers 150 are operable to retain the blades 116, the cap 114, the lubricating strip 115, and the guard bar 118 within the shaving head 100. The retainers 150 are installed on a respective one of the side walls 110, 112 of the housing 101. It is foreseen that the retainers 150 may be installed in other walls or only one of the side walls 110, 112 of the housing 101 as desired without deviating from the scope of the present inventive concept. As illustrated, the retainers 150 retain the plurality of shaving head components 113 by securely abutting and partially covering (i) a portion of the components, e.g., lateral sides or sides along the direction X of the components, and (ii) the side walls 110, 112. It is foreseen that the retainers 150 may be operable to secure one or more other components within or on the shaving head 100 without deviating from the scope of the present inventive concept. It is also foreseen that any one or more of the plurality of shaving head components 113 may be secured to the shaving head 100 without or in coordination with the retainers 150, e.g., using other securing means such as welding, adhesive or the like, without deviating from the scope of the present inventive concept.

The retainers 150 may be made preferably of a resilient material, such as plastic, metal, or other similar material or any combination thereof without deviating from the scope of the present inventive concept. The resilient material is sufficiently rigid to prevent deflection of the retainers 150 during shaving, thereby preventing a change of exposure of one or more of the blades 116. Each of the retainers 150 include a central retainer body 152 that is generally flat and extends along a single plane in first and second directions. It is foreseen, however, that the retainer body 152 may be concave or convex without deviating from the scope of the present inventive concept. For instance, if the retainer body 152 is convex, such will cause a middle one or ones of the blades 116 to have a lower exposure compared to outer ones of the blades 116. Conversely, if the retainer body 152 is concave, such will cause a middle one or ones of the blades 116 to have a higher exposure compared to outer ones of the blades 116. Such convex and concave designs of the retainer body 152 each provides an exposure range of −100 μm to 150 μm and more preferably an exposure range of −50 μm to 100 μm. The retainer body 152 includes a front 154 extending toward and facing a front of the shaving head 100, a rear 156 extending toward and facing a rear of the shaving head 100, an exterior side 158 extending toward and facing an exterior side of the shaving head 100, and an interior side 160 extending toward and facing an interior side of the shaving head 100.

The retainer body 152 includes a front leg 170 extending from the front 154 of the retainer body 152, a rear leg 172 extending from the rear 156 of the retainer body 152, and a side leg 174 extending from the exterior side 158 of the retainer body 152. It is foreseen that the retainer body 152 could include a plurality of front legs 170, a plurality of rear legs 170, and/or plurality of side legs 174 without deviating from the scope of the present inventive concept. It is also foreseen that the retainer body 152 could include no front leg 170, rear leg 170, and/or side leg 174 without deviating from the scope of the present inventive concept.

The front leg 170 and the rear leg 172 extend, at least partially, parallel to each other along the single plane defined by the retainer body 152. It is foreseen, however, that the front leg 170 and the rear leg 172 may not extend parallel to each other and/or the retainer body 152 without deviating from the scope of the present inventive concept.

The front leg 170 includes a linear portion 180 extending parallel to the retainer body 152. The front leg 170 further includes an upper curved portion 182 that causes an intermediate portion 184 of the front leg 170 to extend nonparallel to the retainer body 152, and a lower curved portion 186 of the front leg 170 that causes the linear portion 180 to extend parallel to the retainer body 152. The portions 182, 184, 186 of the front leg 170 extend between the retainer body 152 and the linear portion 180 of the front leg 170 in this order. The linear portion 180 of the front leg 170 extends into and is received by a front channel or front groove 188 adjacent to the first longitudinal wall 106 of the shaving head 100 such that a tip 189 of the front leg 170 and a substantial portion of the linear portion 180 of the front leg 170 are housed within the front groove 188. It is foreseen that the portions 180, 182, 184, 186 of the front leg 170 may extend parallel to each other along a single plane and depend from the retainer body 152 at an angle thereto without deviating from the scope of the present inventive concept. For instance, the portions 180, 182, 184, 186 of the front leg 170 may depend from the plane defined by the retainer body 152 at an angle of between 100 degree and 150 degrees. Alternatively, any one or more of the portions 180, 182, 184, 186 of the front leg 170 may be curved, e.g., upward or downward, without deviating from the scope of the present inventive concept. Further, it is foreseen that an entirety of the front leg 170 may be concave without any linear portion, thereby defined by a single radius or a plurality of radii without deviating from the scope of the present inventive concept.

The rear leg 172 includes a linear portion 190 extending parallel to the retainer body 152. The rear leg 172 further includes an upper curved portion 192 that causes an intermediate portion 194 of the rear leg 172 to extend nonparallel to the retainer body 152, and a lower curved portion 196 of the rear leg 172 that causes the linear portion 190 to extend parallel to the retainer body 152. The portions 192, 194, 196 of the rear leg 172 extend between the retainer body 152 and the linear portion 190 of the rear leg 172 in this order. The linear portion 190 of the rear leg 172 extends into and is received by a rear channel or rear groove 198 adjacent to the second longitudinal wall 108 of the shaving head 100 such that a tip 199 of the rear leg 172 and a substantial portion of the linear portion 190 of the rear leg 172 are housed within the rear groove 198. The linear portion 190 of the rear leg 172 is about 1.0 mm long and about 0.5 mm wide and the rear groove 198 is about 1.05 mm long and about 0.45 mm wide. It is foreseen that the portions 190, 192, 194, 196 of the rear leg 172 may extend parallel to each other along a single plane and depend from the retainer body 152 at an angle thereto without deviating from the scope of the present inventive concept. For instance, the portions 190, 192, 194, 196 of the rear leg 172 may depend from the retainer body 152 at an angle of between 30 degree and 60 degrees. Alternatively, any one or more of the portions 190, 192, 194, 196 of the rear leg 172 may be curved, e.g., upward or downward, without deviating from the scope of the present inventive concept. Further, it is foreseen that an entirety of the rear leg 172 may be concave without any linear portion, thereby defined by a single radius or a plurality of radii without deviating from the scope of the present inventive concept.

The side leg 174 includes upper and lower linear portions 200, 202 extending parallel to the retainer body 152. The side leg 174 further includes an upper curved portion 204 that causes an intermediate portion 206 of the side leg 174 to extend perpendicular to the retainer body 152, and a lower curved portion 208 that causes the lower linear portion 202 to extend parallel to the retainer body 152. The portions 200, 204, 206, 208 of the side leg 174 extend between the retainer body 152 and the lower linear portion 202 of the side leg 174 in this order. The lower linear portion 202 of the side leg 174 extends under the bottom side 104 of the shaving head 100 such that a tip 209 of the side leg 174 and a substantial portion of the lower linear portion 202 of the side leg 174 are entirely below the bottom side 104 of the shaving head 100. It is foreseen that the portions 200, 202, 204, 206, 208 of the side leg 174 may extend parallel to each other along a single plane and depend from the retainer body 152 at an angle thereto without deviating from the scope of the present inventive concept. For instance, the portions 200, 202, 204, 206, 208 of the side leg 174 may depend from the retainer body 152 at an angle of between 30 degree and 60 degrees. Alternatively, any one or more of the portions 200, 202, 204, 206, 208 of the side leg 174 may be curved, e.g., upward or downward, without deviating from the scope of the present inventive concept. Further, it is foreseen that an entirety of the side leg 174 may be concave without any linear portion, thereby defined by a single radius or a plurality of radii without deviating from the scope of the present inventive concept. Still further, it is foreseen that the side leg 174 may include a plurality of side legs that are either operable to function the same as or similar to the side leg 174 and/or be spaced from or loosely abut the retainer body 152 to provide an aesthetic enhancement thereto, e.g., an external rib.

The legs 170, 172, 174 extend (i) at least partially parallel to each other, (ii) at least partially nonparallel to the retainer body 152, and (iii) at least partially parallel to the retainer body 152. In this manner, the retainer body 152 and the legs 170, 172, 174 define and partially surround an interior cavity 210.

The retainer body 152 includes an interior abutment surface 212 on an interior side of the retainer body 152 that faces toward the interior cavity 210. The interior abutment surface 212 of the retainer body 152 is operable to abut one or more of the plurality of shaving head components 113. The linear portion 180 of the front leg 170 includes exterior and interior abutment surfaces 214, 216 that respectively face away from or towards the interior cavity 210. Each of the abutment surfaces 214, 216 of the front leg 170 are operable to abut an internal surface of the front groove 188. The linear portion 190 of the rear leg 172 includes exterior and interior abutment surfaces 218, 220 that respectively face away from or towards the interior cavity 210. Each of the abutment surfaces 214, 216 of the rear leg 172 are operable to abut an internal surface of the rear groove 198. The side leg 174 includes an interior abutment surface 224 on an interior side of the side leg 174 that faces toward the interior cavity 210 and is operable to abut the bottom side 104 of the shaving head 100. The side leg 174 (*i*) abuts and partially surrounds a respective one of the first side wall 110 and the second side wall 112, and (ii) abuts the bottom side 104 of the shaving head 100. In this manner, the retainer body 152 and the legs 170, 172, 174 cooperatively secure the one or more of the plurality of shaving head components 113 on or within the shaving head 100.

Figure 4:
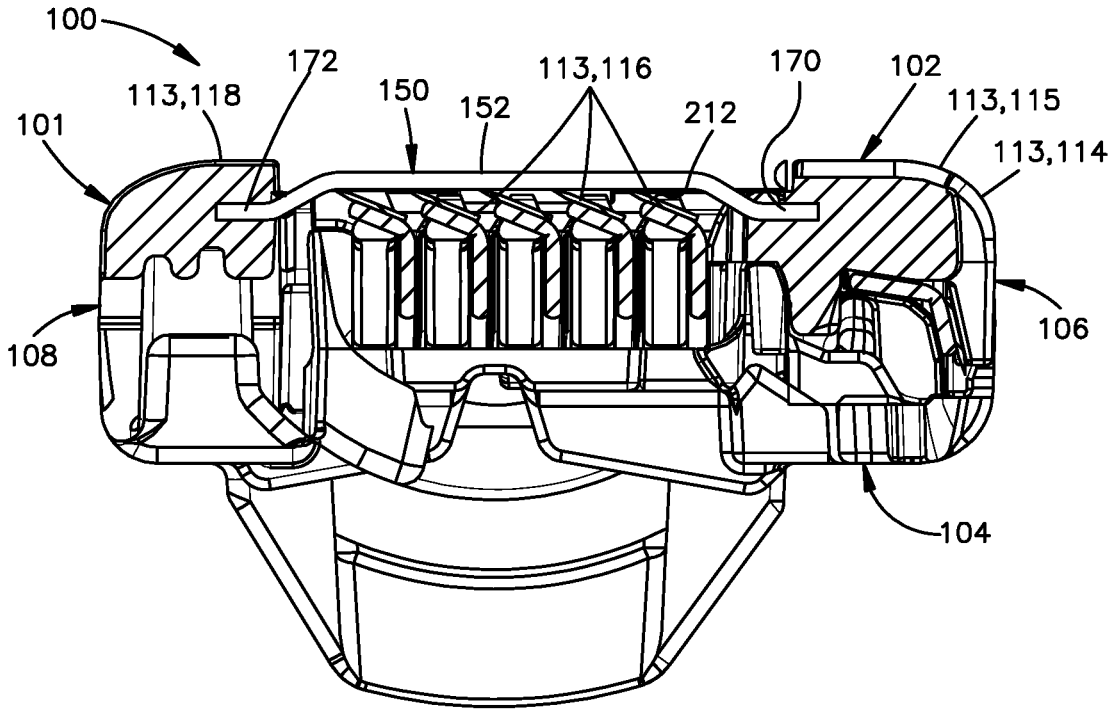
FIG. 4 is a diagram illustrating a cross-sectional side elevation view of the shaving head with the retainer of FIG. 2.
Figure 5:
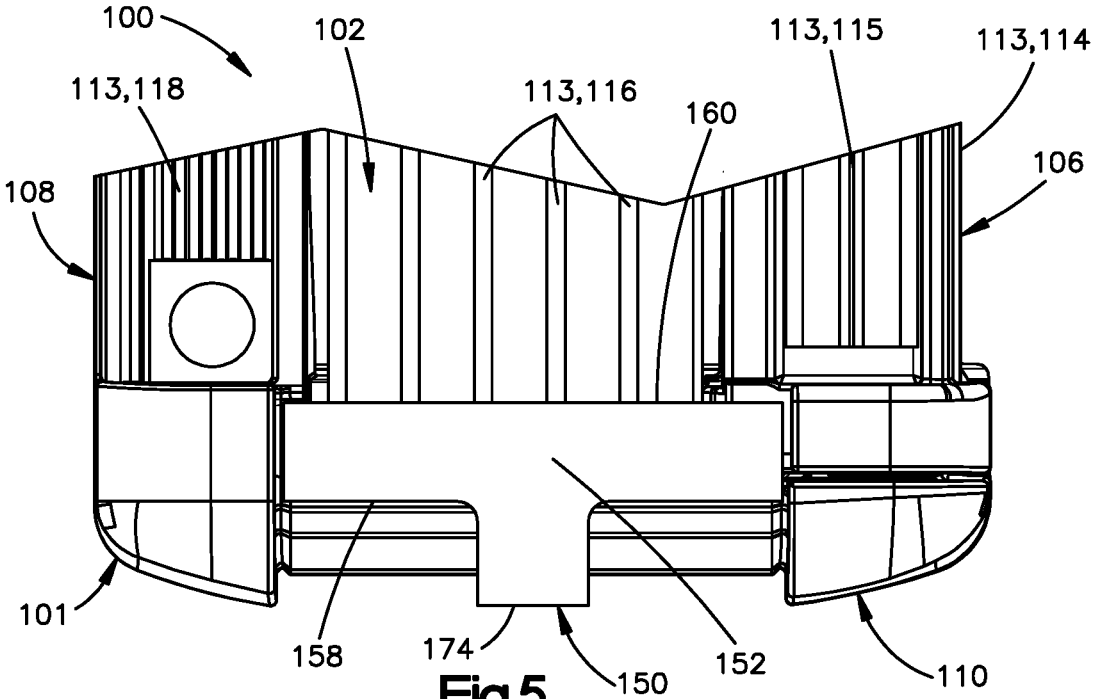
FIG. 5 is a diagram illustrating a top plan view of the shaving head with the retainer of FIG. 2.
Figure 6:
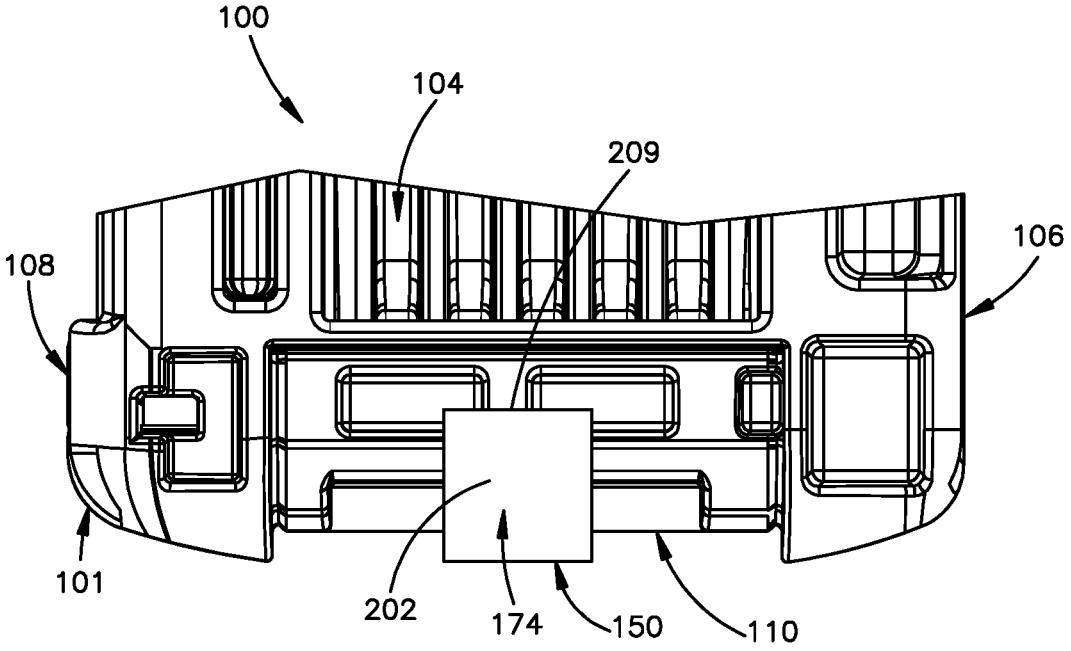
FIG. 6 is a diagram illustrating a bottom plan view of the shaving head with the retainer of FIG. 2.
Figure 7:
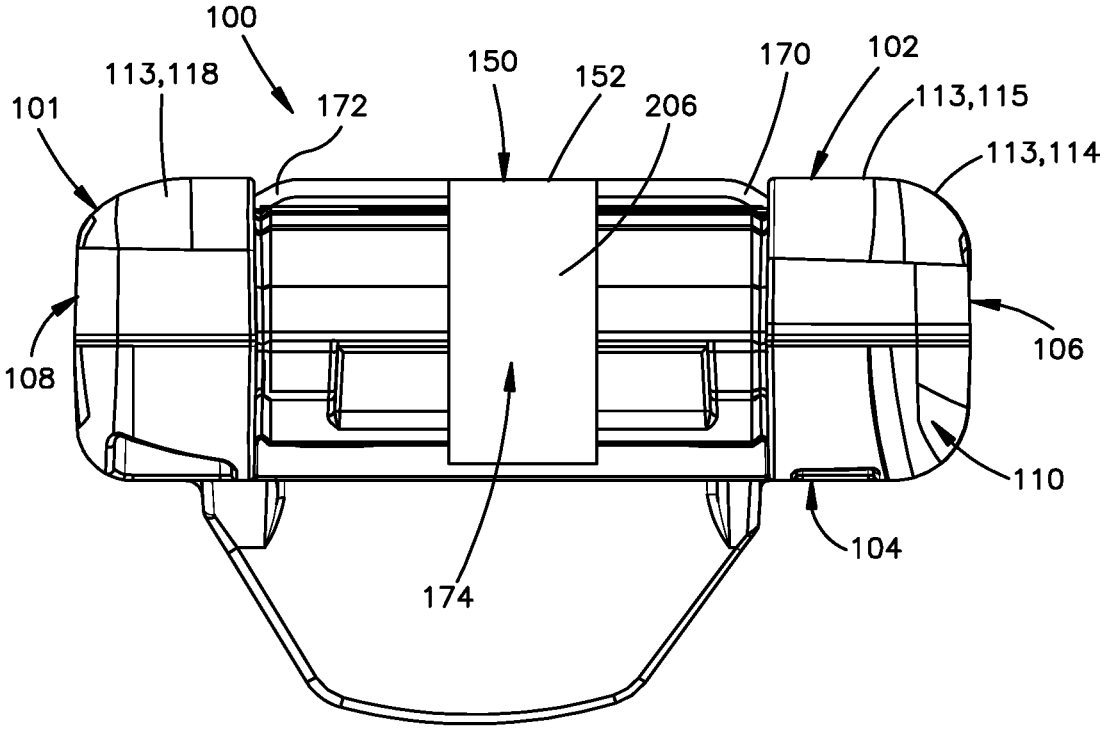
FIG. 7 is a diagram illustrating a side elevation view of the shaving head with the retainer of FIG. 2.

The grooves 188, 198 are defined by an end cap 230 of the housing 101 on each of the side walls 110, 112 of the shaving head 100 and are spaced from the each of the side walls 110, 112 as illustrated by FIGS. 4 and 5. It is foreseen, however, that each of the grooves 188, 198 may extend up to its respective one of the side walls 110, 112 without deviating from the scope of the present inventive concept. It is also foreseen that the each of the grooves 188, 198 may extend laterally along a respective one of the longitudinal walls 106, 108, thereby operable to laterally receive the retainers 150 without deviating from the scope of the present inventive concept. The front groove 188 is positioned adjacent to the first longitudinal wall 106 and includes upper and lower interior surfaces 232, 234 operable to respectively abut the abutment surfaces 214, 216 of the front leg 170. The rear groove 198 is positioned adjacent to the second longitudinal wall 108 and includes upper and lower interior surfaces 236, 238 operable to respectively abut the abutment surfaces 218, 220 of the rear leg 172. The surfaces 232, 234, 236, 238 are contoured to follow a contour of the retainers 150, thereby offering increased retention of the retainer 150 and components 113 and preventing deformation of the retainer 150 during use of the shaving razor 10.

The linear portions 180, 190 of the legs 170, 172 are about 1.0 mm long. A corresponding length of the grooves 184, 198 is at least double the width of the linear portions 180, 190, thereby allowing the grooves 184, 198 to absorb any possible forces created during use of the shaving razor 10. Each of the retainers 150 have a uniform thickness of 0.4 mm to 1.0 mm and preferably about 0.5 mm to permit slight deformation of the retainers 150 during assembly of the retainers 150 on the shaving head 100 and post assembly. A height of the retainers 150 above a shaving plane defined by the blades 116 depends on preferred exposure of the blades 116, but may be between 0.9 mm and 0.5 mm and is preferably about 0.5 mm. A width of the retainers 150 is such that the retainers 150 is operable to simultaneously hold a portion of the blades 116 and cover a portion of the housing 101 while providing resistance to any force that may result in inadvertent disassembly of the shaving razor 10. The width of the retainers 150 may vary from two times to five times (2*x*-5*x*) the thickness of the retainers 150 and is preferably about 3.4 mm. A height of the side arm 174 is between 2.75 mm and 5.5 mm and preferably about 5.4 mm. It is foreseen that the side arm 174 may extend from any portion of the exterior side 158 of the retainer body 152, but it is preferred that the side arm 174 extend from an approximate center portion of the exterior side 158 of the retainer body 152 to provide balance to the shaving head 100. The lower linear portion 202 of the side leg 274 has a length between 2.0 mm and 4.5 mm and is preferably about 4.1 mm.

Figure 3:
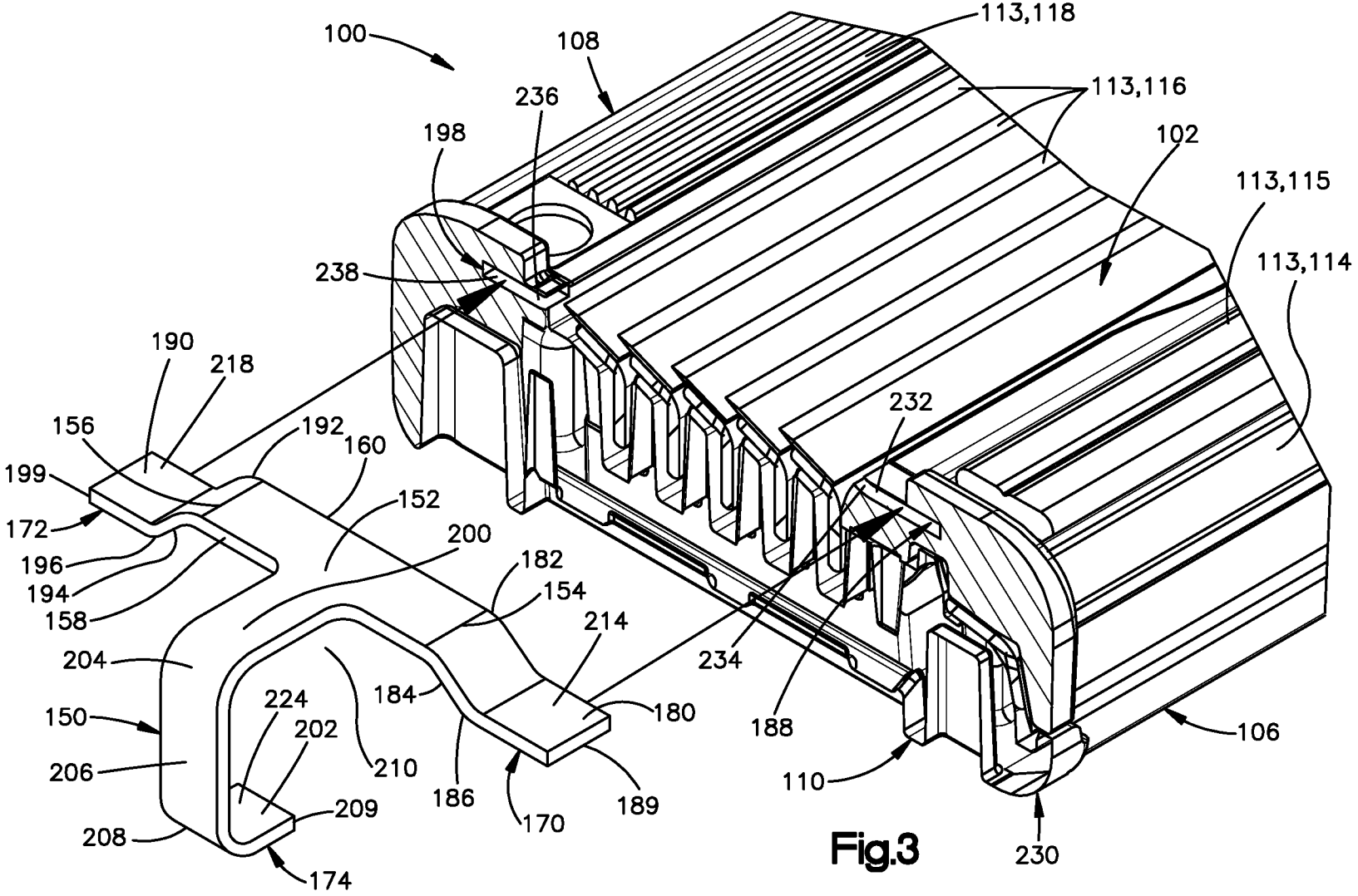
FIG. 3 is a diagram illustrating an exploded view of a shaving head with the retainer of FIG. 2.

Prior to assembly of the shaving head 100, the side leg 174 of each of the retainers 150 is in a bent configuration, i.e., an original uninstalled configuration or "unloaded" configuration as illustrated by FIG. 3. The resilient nature of the material of the retainers 150 causes the retainers 150, once installed or loaded onto the housing 101, i.e., a "loaded" configuration, to impart a spring-force pressure on the housing 101. To secure the retainers 150 to the housing 101, the linear portions 180, 190 of the legs 170, 172 of each of the retainers 150 are respectively and simultaneously guided or slid into the grooves 188, 198 on each of the end caps 230 until the intermediate portion 206 of the side leg 174 abuts the housing 101 of the shaving head 100. Next, the leg 174 is flexibly expanded from the unloaded configuration and beyond the loaded configuration, positioned so that the end cap 230 is within the interior cavity 210, and released. Upon release of the leg 174, the resilient nature of the material of the retainers 150 causes the retainers 150 to be biased toward the unloaded configuration. The end caps 230 prevent the retainers 150 from completely returning to the unloaded configuration and cause the leg 174 of each of the retainers 150 to be displaced a distance from the unloaded configuration and maintained in the loaded configuration, which is different, i.e., expanded, relative to the unloaded configuration prior to being installed on the shaving head 100. In this manner, the retainers 150 secure the components 113 onto the shaving head 100 via a spring-force pressure. It is foreseen that the retainers 150 may be installed without the loaded configuration and not impart the spring-force pressure on the housing 101 without deviating from the scope of the present inventive concept. It is also foreseen that one or more of the legs 170, 172, 174 may include a tooth or other friction-enhancement portion on a portion thereof, e.g., one or more of the portions 180, 182, 184, 186, 190, 192, 194, 196, 200, 202, 204, 206, 208 to increase friction between the retainers 150 and the housing 101, thereby preventing inadvertent displacement of the retainers 150 with respect to the housing 101 without deviating from the scope of the present inventive concept.

It will be appreciated by those skilled in the art that changes could be made to the embodiments described above without departing from the broad inventive concept thereof. It is understood, therefore, that the present invention disclosed herein is not limited to the particular embodiments disclosed, and is intended to cover modifications within the spirit and scope of the present invention.

What is claimed is:

1. A shaving head comprising:

at least one shaving head component extending at least partially along a length of the shaving head;

at least one groove extending at least partially along a side of the at least one shaving head component, the at least one groove including opposing parallel interior surfaces;

a retainer having (i) a central retainer body extending along a plane, (ii) a front leg extending from a front of the central retainer body, (iii) a rear leg extending from a rear of the central retainer body, and (iv) a side leg extending from a side of the central retainer body;

the front leg including a curved portion extending from the front of the central retainer body, an intermediate portion extending from the curved portion at an angle to the retainer body in a direction away from the front of the central retainer body, and a linear portion extending from the intermediate portion parallel to the plane of the central retainer body and in a direction away from the central retainer body;

the rear leg including a curved portion extending from the rear of the central retainer body, an intermediate portion extending from the curved portion at an angle to the central retainer body in a direction away from the rear of the central retainer body, and a linear portion extending from the intermediate portion parallel to the plane of the central retainer body and in a direction away from the central retainer body;

at least the front leg or the rear leg of the retainer being disposed between the opposing parallel interior surfaces of the at least one groove and secured within the at least one groove to secure the at least one shaving head component to the shaver head, wherein the side leg is configured to surround a side portion of the shaving head and abut a bottom portion of the shaving head.

2. The shaving head of claim 1, wherein the at least one groove extends (i) at least partially along the length of the shaving head, and (ii) perpendicular to the plane defined by the body.

3. The shaving head of claim 1, wherein the at least one groove includes a first groove and a second groove and each of the front leg, the rear leg, and the side leg (i) partially surrounds a portion of the shaving head, or (ii) extends into the first groove and the second groove.

4. The shaving head of claim 1, wherein the retainer body includes an abutment surface configured to abut one or more shaving head components.

5. The shaving head of claim 4, wherein each of the front leg, the rear leg, and the side leg include an abutment surface operable to abut (i) a bottom side of the shaving head, (ii) a first groove of the at least one groove, or (iii) a second groove of the at least one groove.

6. The shaving head of claim 5, wherein the retainer body, the front leg, the rear leg and the side leg define and partially surround an interior cavity; the abutment surfaces of the retainer body and the side leg are on an interior side facing the interior cavity, and the abutment surfaces of the front leg and the rear leg are on an exterior side.

7. The shaving head of claim 1, wherein the at least one groove includes a first groove and a second groove, the front leg and the rear leg are configured to be simultaneously received into a respective one of the first groove and the second groove.

8. The shaving head of claim 1, wherein the at least one groove includes a first groove and a second groove, each of the front leg and the rear leg is slidable along a portion of a respective one of the first groove and the second groove until a portion of the side leg abuts the shaving head.

9. The shaving head of claim 1, wherein the retainer is formed of a resilient material, and wherein the retainer is flexible during installation of the retainer on the shaving head and, after installation of the retainer on the shaving head, remain in an expanded configuration thereby securing the retainer to the shaving head via a spring force.

10. The shaving head of claim 9, wherein the expanded configuration is different than an uninstalled configuration of the retainer prior to being installed on the shaving head.

11. The shaving head of claim 9, wherein the retainer is flexible via movement of the side leg relative to the front leg or rear leg of the retainer.

12. The shaving head of claim 1, wherein the at least one groove is disposed proximate an upper portion of a housing of the shaving head.

13. The shaving head of claim 1, wherein the at least one groove is disposed above the at least one shaving head component.

14. The shaving head of claim 1, wherein the at least one groove is disposed opposite a bottom portion of the shaving head in relation to the at least one shaving head component.

15. The shaving head of claim 1, wherein the central retainer body and at least one of the front leg or the rear leg are disposed opposite a bottom portion of the shaving head in relation to the at least one shaving head component.

16. A shaving head, comprising:

at least one shaving head component extending at least partially along a length of the shaving head;

at least one groove extending at least partially along a side of the at least one shaving head component, the at least one groove including opposing parallel interior surfaces;

a retainer having (i) a central retainer body extending along a plane, (ii) a front leg extending from a front of the central retainer body, (iii) a rear leg extending from a rear of the central retainer body, and (iv) a side leg extending from a side of the central retainer body;

the front leg including a curved portion extending from the front of the central retainer body, an intermediate portion extending from the curved portion at an angle to the retainer body in a direction away from the front of the central retainer body, and a linear portion extending from the intermediate portion parallel to the plane of the central retainer body and in a direction away from the central retainer body;

the rear leg including a curved portion extending from the rear of the central retainer body, an intermediate portion extending from the curved portion at an angle to the central retainer body in a direction away from the rear of the central retainer body, and a linear portion extending from the intermediate portion parallel to the plane of the central retainer body and in a direction away from the central retainer body;

at least the front leg or the rear leg of the retainer being disposed between the opposing parallel interior surfaces of the at least one groove and secured within the at least one groove to secure the at least one shaving head component to the shaver head, wherein the linear portions of both the front leg and the rear leg at least partially extend (i) substantially parallel to each other along the plane, and the intermediate portions of both the front leg and the rear leg at least partially extend (ii) in the range of 100-150 degrees to the plane defined by the retainer body.

* * * * *